US008113368B2

(12) United States Patent
Oguchi et al.

(10) Patent No.: US 8,113,368 B2
(45) Date of Patent: Feb. 14, 2012

(54) SYNTHETIC RESIN BOTTLE WITH SPIRALLY INCLINED PILLARS

(75) Inventors: Hiroki Oguchi, Tokyo (JP); Tomoyuki Ozawa, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 441 days.

(21) Appl. No.: 11/919,067

(22) PCT Filed: May 8, 2006

(86) PCT No.: PCT/JP2006/309224

§ 371 (c)(1), (2), (4) Date: Dec. 17, 2009

(87) PCT Pub. No.: WO2006/129449

PCT Pub. Date: Dec. 7, 2006

(65) Prior Publication Data

US 2010/0089865 A1 Apr. 15, 2010

(30) Foreign Application Priority Data

May 31, 2005 (JP) ..... 2005-159597

(51) Int. Cl.
*B65D 1/02* (2006.01)
*B65D 1/42* (2006.01)

(52) U.S. Cl. ..... 215/381; 215/382; 220/669; 220/675

(58) Field of Classification Search ..... 215/381, 215/382, 379; 220/669, 675
See application file for complete search history.

(56) References Cited

U.S. PATENT DOCUMENTS

| | | | | |
|---|---|---|---|---|
| 5,704,504 | A * | 1/1998 | Bueno | 215/381 |
| D416,198 | S * | 11/1999 | Lindsay et al. | D9/520 |
| D442,474 | S * | 5/2001 | Piccioli et al. | D9/667 |
| 6,520,362 | B2 * | 2/2003 | Heisel et al. | 215/381 |

FOREIGN PATENT DOCUMENTS

| | | |
|---|---|---|
| JP | U 06-059207 | 8/1994 |
| JP | A 10-058527 | 3/1998 |
| JP | A 2002-053118 | 2/2002 |

* cited by examiner

*Primary Examiner* — Sue Weaver
(74) *Attorney, Agent, or Firm* — Oliff & Berridge, PLC

(57) ABSTRACT

A synthetic resin bottle is provided with a shape that improves rigidity and strength in a lateral direction, without increasing the cost of material to thicken the bottle wall. The synthetic resin bottle is provided at a low cost in such a way that the bottles can be used smoothly on the carrier line, in vending machines, and in storage in stacks with no deformation. The bottles are capable of performing a vacuum-absorbing function enough to be used in hot filling. Multiple pillar sections in a projected strip-like shape are disposed on the body of a synthetic resin bottle, the pillar sections being inclined spirally at a uniform angle of gradient ($\alpha$) relative to a central axis of the bottle and disposed in parallel to one another, so that the cylindrical body wall is prevented from being deformed by a pressure force acting in a lateral direction.

7 Claims, 6 Drawing Sheets

[Fig.1]
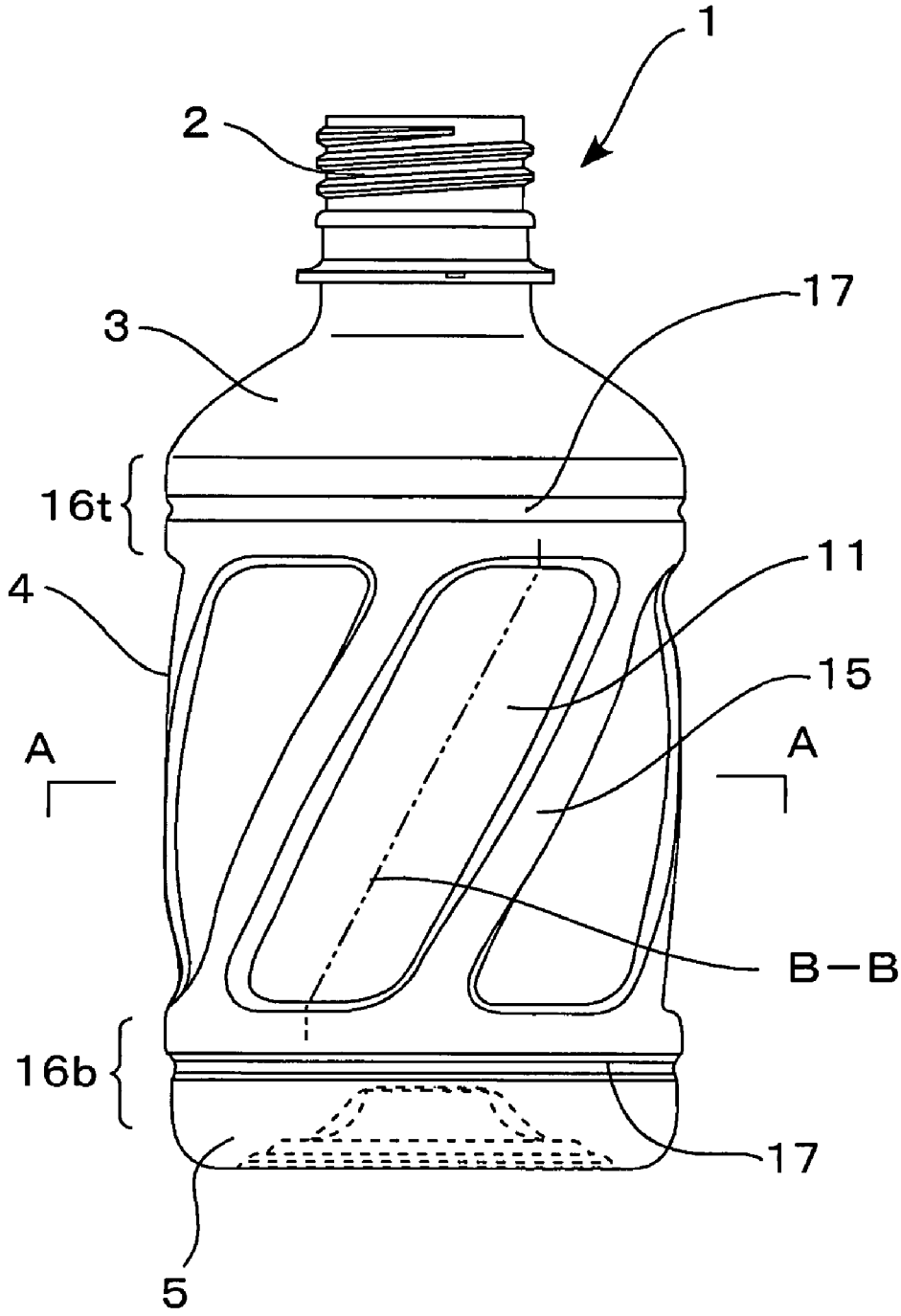

[Fig.2]
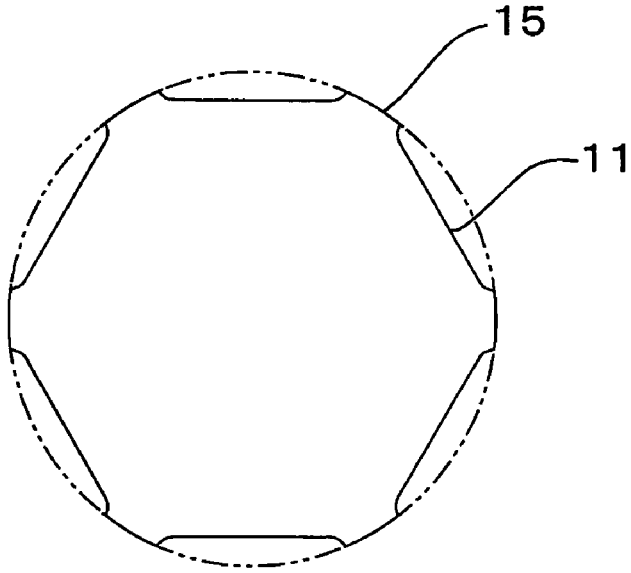
(a)
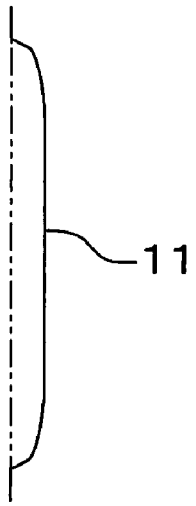
(b)

[Fig.3]
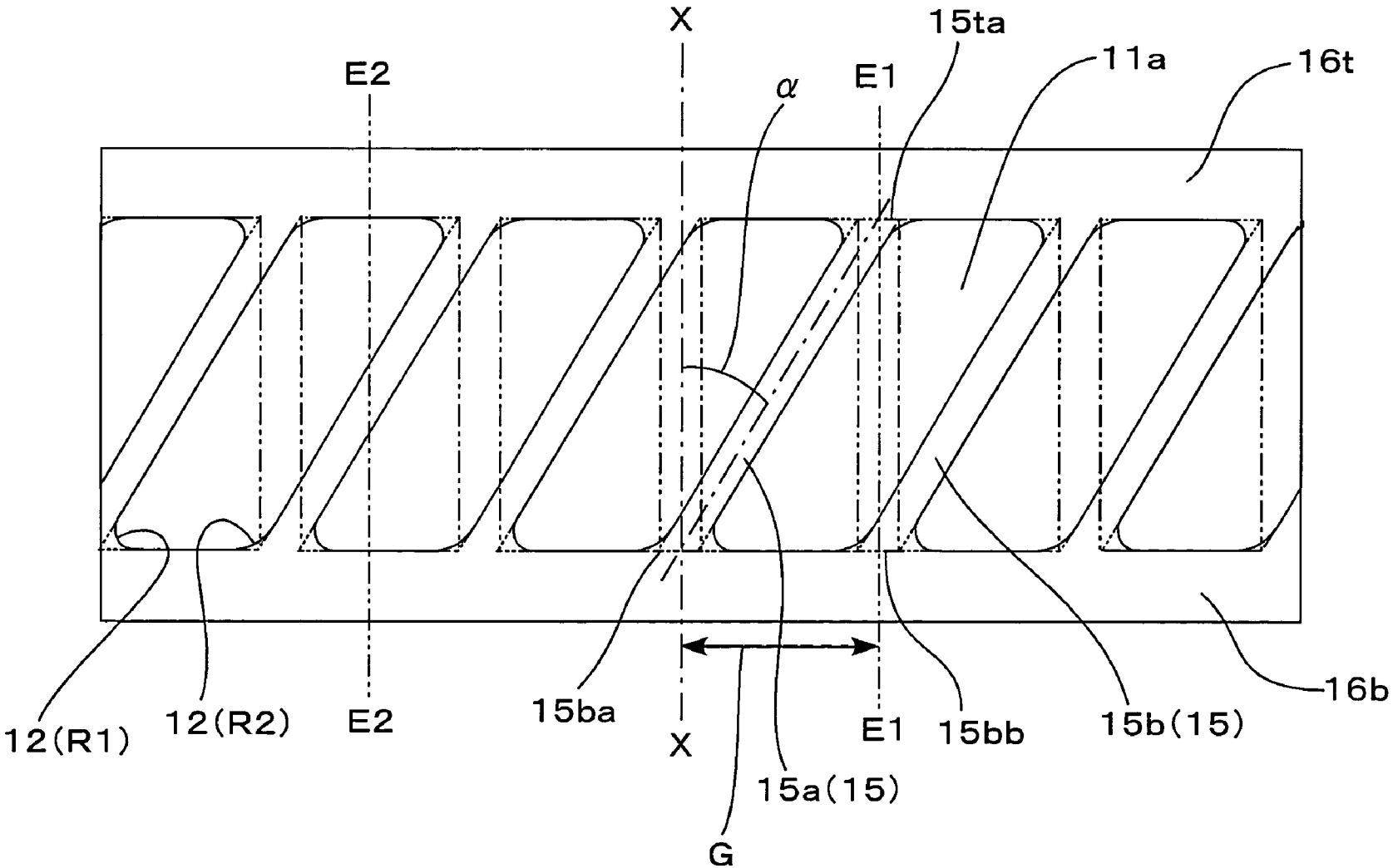

[Fig.4]
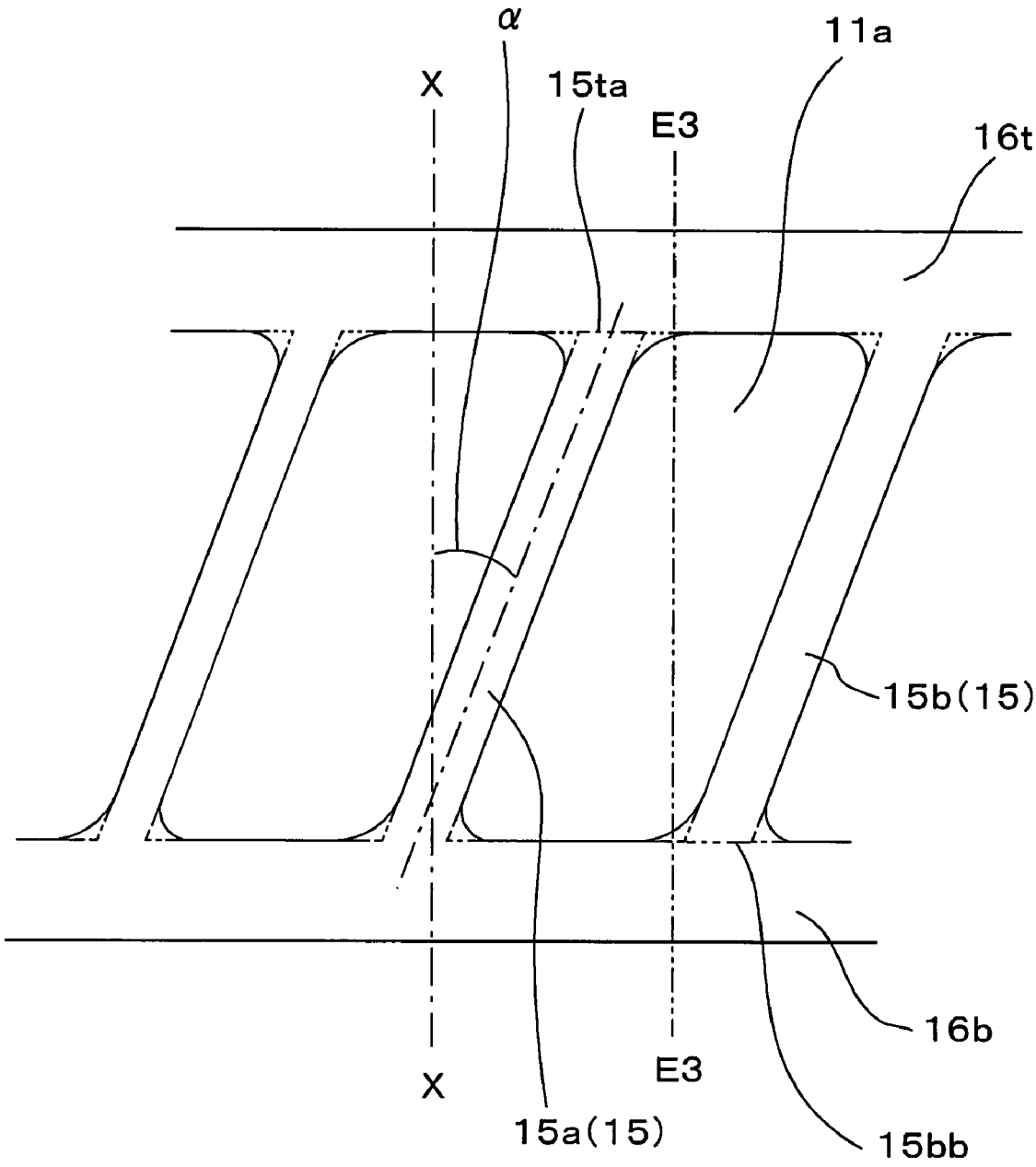

[Fig.5]
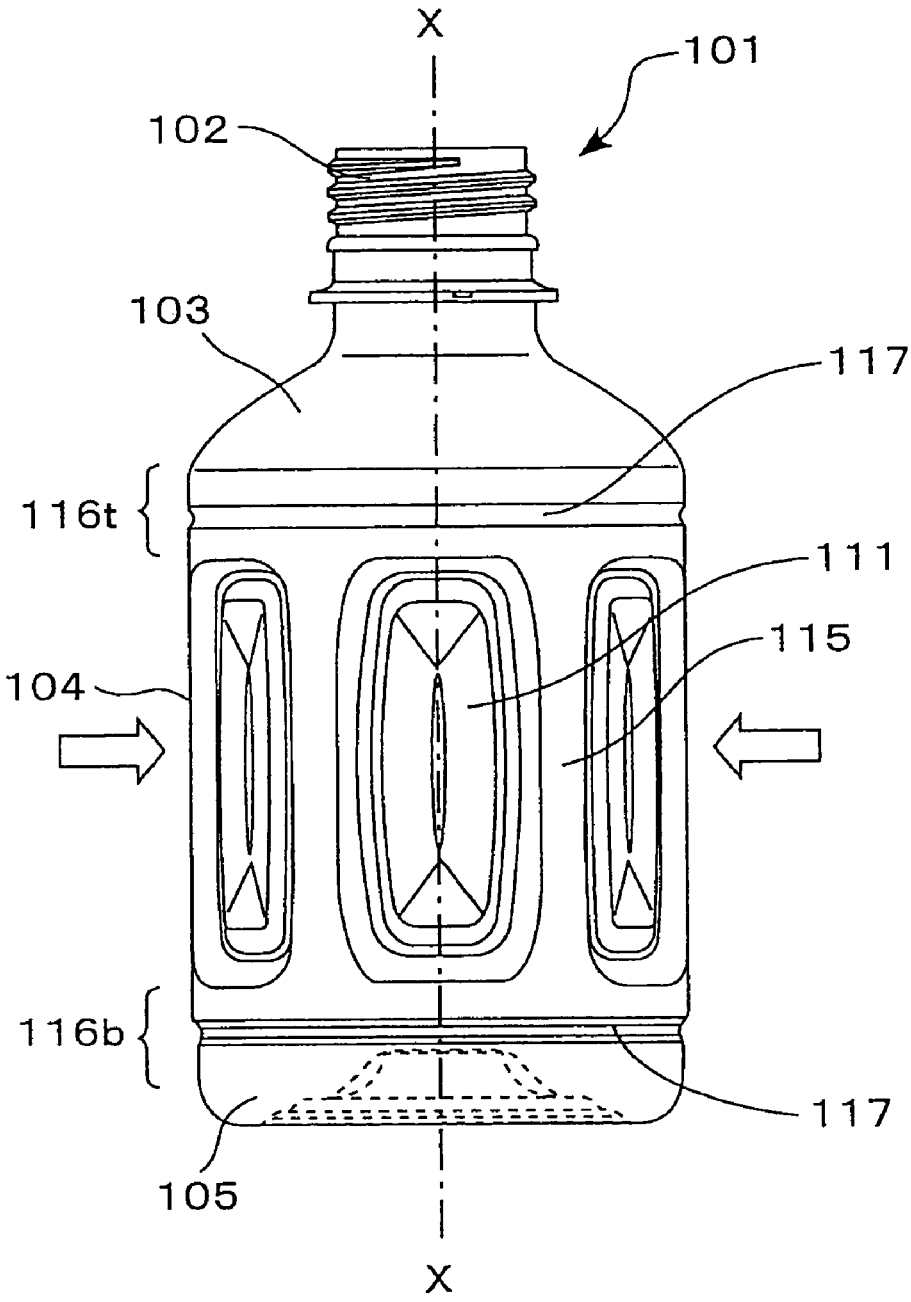
Related Art

[Fig.6]
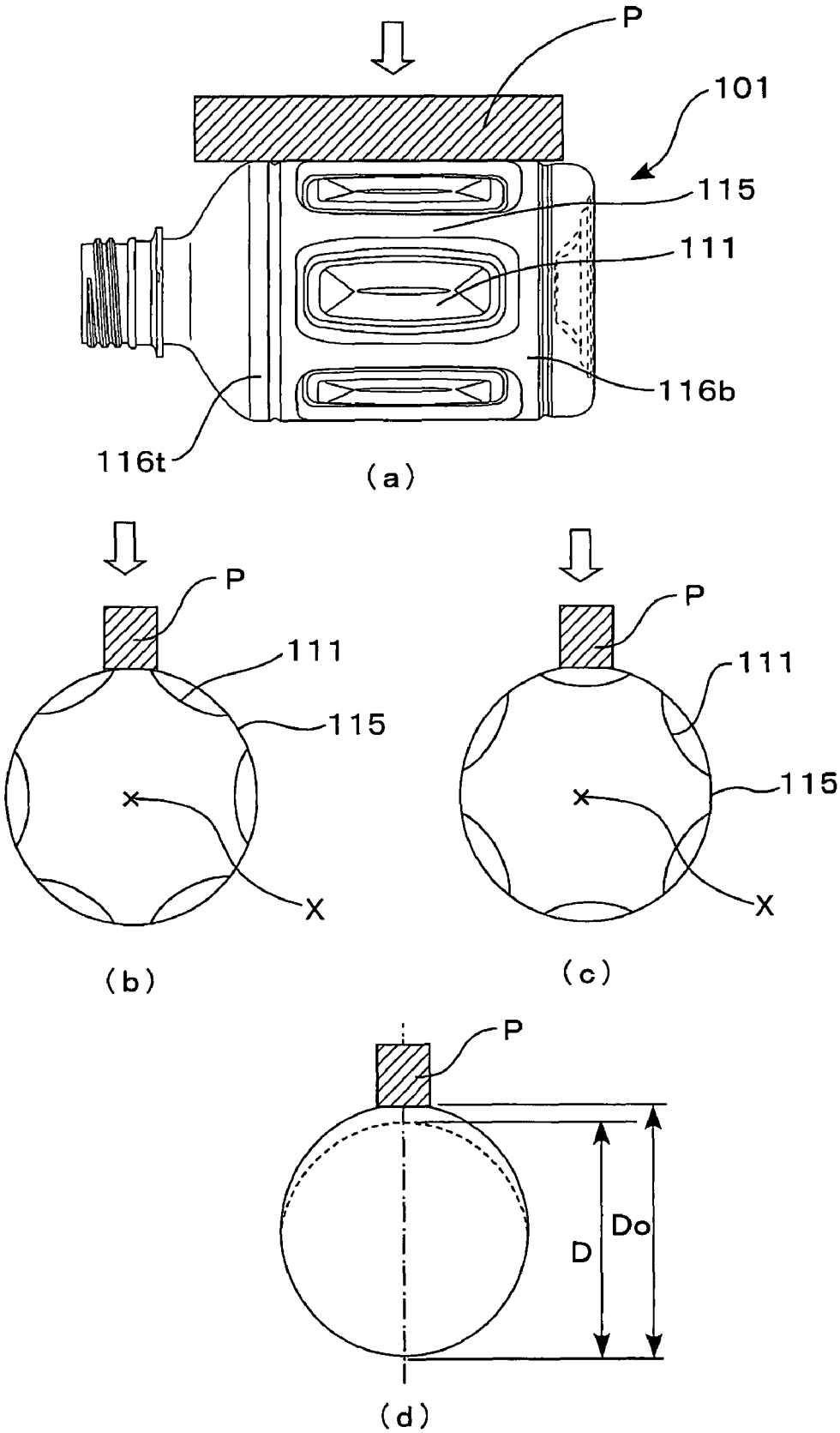

SYNTHETIC RESIN BOTTLE WITH SPIRALLY INCLINED PILLARS

BACKGROUND

This invention relates to a synthetic resin bottle, and in particular, to a synthetic resin bottle that resists deformation caused by pressure force coming from a lateral direction.

Synthetic resin bottles made of a polyethylene terephthalate resin (hereinafter referred to as a PET resin) and the like have been in wide use until today as the containers for various drinks. With a trend toward thin body wall intended for material cost reduction, the bottle shape design has to face large problems, including how to secure full strength and rigidity as the bottle and how to obscure the body wall deformation caused by pressure fluctuation inside the bottle.

For example, Japanese Published patent application JP-A-1998-58527 includes descriptions concerning a bottle having vacuum-absorbing panels in the body portion. This bottle is used for the so-called hot filling process in which the bottle is filled with such contents as juice, tea, etc., which require sterilization at about 90 degrees C. Since the bottle is filled with the contents at about 90 degrees C., then capped, sealed, and cooled, the bottle inside is put under a fairly reduced pressure condition, and the bottle wall deformation becomes problematic.

FIG. 5 shows a small, round PET bottle of a conventional type, having a capacity of 280 ml. The bottle comprises a neck 102, a shoulder 103, a body 104, and a bottom 105. The body 104 is provided with six vacuum-absorbing panels 111 which are dented from body wall. These vacuum-absorbing panels 111 have broadly flat surfaces, but if the inside of the bottle 101 is put under a reduced pressure condition, the panels can be further dented inward easily. In its appearance, the bottle gives no impression of distorted deformation. That is, the vacuum-absorbing panels 111 are capable of inconspicuously performing a function of absorbing the reduced pressure or alleviating the reduced pressure condition (hereinafter referred to as the vacuum-absorbing function).

In the meantime, rigidity or buckling strength (hereinafter referred to simply as the strength) against the pressure force acting in the direction of central axis X of the bottle (hereinafter also referred to as the vertical direction) is predominantly borne by pillar sections 115 formed upright between adjacent vacuum-absorbing panels 111. The rigidity or buckling strength against the pressure force acting in the direction perpendicular to the central axis X (hereinafter referred to as the lateral direction) (See the direction of outline arrows in FIG. 5) is borne by short cylindrical circular sections 116*t*, 116*b*, which are disposed in the portions on and under the vacuum-absorbing panels 111. If necessary, each of these circular sections are provided with a circumferential groove 117 which largely performs a function of a circumferential rib to increase the rigidity and the buckling strength in the lateral direction. Owing to the pillar sections 115 and the circular sections 116*t* and 116*b*, the rigidity and strength in both of vertical and lateral directions can be secured for the bottle, with no trouble of deformation, in the production, distribution, and sales, including the process of filling the bottle with the contents, the bottle carrier line, the storage under a stacked condition, the sales by means of vending machines, and the cases where bottles are somehow exposed to external force.

If the body is more and more thin-walled in the future, the body wall will deform when it is exposed to a slight change in inner pressure caused by a change in ambient temperature. This occurs not only in those bottles for use in a hot filling process, such as described above, but also in ordinary bottles for use in normal-temperature filling, such as, for example, aseptic filling wherein the contents are filtered by a ultrafiltration technique to remove bacteria or wherein the contents are flash-pasteurized at a high temperature for a short period and are then filled by aseptic filling at normal temperature. Therefore, a design approach to the shape of bottles for use in hot filling described above can be effectively applied not only to the bottles for use in hot filling, but also to ordinary bottles for use in normal temperature filling. In other words, based on this design approach, it is possible to intentionally form easily deformable vacuum-absorbing panels in a dented state in the body wall to let the panels deal with pressure fluctuation inside the bottle and to secure the bottle rigidity and strength by means of the pillar sections and the circular sections that are left undented and disposed to surround the vacuum-absorbing panels.

However, small bottles with a capacity of 350 ml or 280 ml have a problem in that they are limited in the area where vacuum-absorbing panels can be formed, as compared to larger bottles, thus making it difficult to secure satisfactorily both of the vacuum-absorbing function of the vacuum-absorbing panels and the rigidity of the bottle. The bottle rigidity in the vertical direction can be secured relatively easily by the upright pillar sections 115 shown in FIG. 5, but the rigidity and strength in the lateral direction are difficult to secure. If lateral rigidity and strength were not enough, the bottles would not be carried smoothly by the carrier line because their alignment on the line is disturbed. Bottles would also deform when they are packed horizontally in boxes and are stacked for storage. Inside the vending machines, many bottles are stacked horizontally. Under this condition, the body of a lowermost bottle would come in contact with the stopper for discharge and would be distorted in the lateral direction. As a result, the bottle would come free from the stopper, and a crucial problem arises in that a few bottles would be discharged at a burst.

The rigidity and strength of the bottle in the lateral direction can be increased by additionally disposing a circumferential ridge or groove at a position of middle height of the body to let the ridge or groove serve as a circumferential rib. However, such a circumferential ridge or groove would limit the area in which vacuum-absorbing panels can be formed, and it would not be possible to fully secure the vacuum-absorbing function. The smaller the bottle size, the harder it would be to solve this problem, as described above. Fact is that these rigidity and strength have been secured so far by thickening the bottle wall. As a result, there has been an increase in the volume of resin to be used, which resulted in a higher production cost.

SUMMARY

This invention has been made to solve the above-described problems found in conventional art. The technical problem to be solved by this invention is to design a bottle shape that improves the bottle rigidity and strength in the lateral direction, without increasing the cost of material to thicken the bottle wall. The object of this invention is to provide a synthetic resin bottle at a low cost in such a way that the bottles can be used smoothly on the carrier line and in the vending machines, can be in storage on the stacks with no deformation, and are capable of performing a vacuum-absorbing function enough to be used in hot filling.

The means of solving the above-described technical problem is a group of multiple pillar sections in the projected strip-like shape disposed on the body, wherein the pillar sections are inclined spirally at a uniform angle of gradient (a)

relative to central axis of the bottle and disposed in parallel to one another, so that cylindrical wall of the body is prevented from being deformed by the pressure force that acts in a lateral direction.

The basic technical idea is that the pillar sections are inclined relative to the central axis of the bottle so as to give the pillar sections a function as a circumferential ridge-like rib that improves the rigidity and strength against the pressure force in the lateral direction, in addition to performing the function as a support to bear the originally intended load in the vertical direction.

According to the above-described configuration, the pillar sections are inclined spirally at a certain angle of gradient relative to the central axis of the bottle. Therefore, the pillar sections are not on a flat plane, but are curved outward along the body wall. Under this configuration, the pillar sections perform a function as a circumferential rib against the pressure force acting in the lateral direction, and prevent deformation caused by the pressure force that acts on the cylindrical body wall in the lateral direction.

The means of carrying out the invention may include that portions of the cylindrical body wall are dented to form multiple dented panels, in parallel to one another in the circumferential direction, with each pillar section being disposed between two adjacent panels.

The above-described configuration is one of the embodiments of the pillar sections that are inclined relative to the central axis. Under such a configuration, the pillar sections of a bottle having a cylindrical body, for example, remain undented and surround the dented panels. Each of the pillar sections is sandwiched between two adjacent panels, and circular sections in the shape of a short cylinder are formed in the remaining portions on and under the panels.

Thus, the pillar sections are formed in the projected strip-like shape and are disposed spirally on the cylindrical body wall around the central axis of the bottle. They are not on a flat plane, but are curved outward along the body wall. Therefore, the pillar sections are capable of performing a function as a circumferential rib against the pressure force that acts on the cylindrical body wall in the lateral direction and preventing deformation caused by such pressure force.

Looked closely, a single pillar section may have merely a small function as the circumferential rib, but multiple pillar sections are formed and are inclined and curved outward along the body wall. In addition, at both the upper and lower ends, these pillar sections are connected integrally to upper and lower circular sections. Thus, each pillar section does not work independently, but multiple pillar sections are integrated with the upper and lower circular sections to form a network of these pillar sections in the projected strip-like shape and the circular sections over the entire body. Because of this network, the load can be dispersed, and the rigidity and strength against pressure force in the lateral direction can be increased effectively.

The dented panels perform a function of absorbing pressure fluctuation caused by the change in the temperature of contents inside the bottle and by the change in ambient temperature, in addition to the function of forming pillar sections and circular sections. Because of these panels, it is possible to obscure the deformation of cylindrical body wall caused by pressure fluctuation. The vacuum-absorbing function also helps protect the pillar sections and the circular sections against deformation and hold the entire outer frame of the bottle constant. Thus, the bottles having these panels can get away from troubles on the carrier line and in storage under a stacked condition, which troubles may happen to occur because of the deformation of cylindrical body caused by pressure fluctuation.

The action and effect of this invention were described above by taking up an example of cylindrical body. Of course, the action and effect of this invention can also be applied not only to the bottles having a cylindrical body, but also to those bottles with the body in an elliptical shape, an oval shape, or a regular polygonal shape. If the pillar sections had too small an angle of gradient, they would fail to contribute to the rigidity and strength in the lateral direction. On the other hand, if the pillar sections had too large an angle of gradient, they would have small rigidity or buckling strength in the vertical direction, which, by nature, has to be borne by the pillar sections. The extent to which the pillar sections are inclined is the matter of design, including the purpose intended for the bottle and the artistic design work.

The panels may be vacuum-absorbing panels.

Under the above-described configuration, the rigidity and strength of the bottle can be secured without sacrificing the area of panels. Therefore, the bottle of this invention can be utilized for a hot filling application by designing the shape of dented panels properly and allowing the panels to perform the function as the vacuum-absorbing panels.

The angle of gradient may be adjusted so that a part of a pillar section always exists somewhere in the height range of panels at any central-angle position chosen relative to the central axis of the bottle.

The above-described configuration is especially effective, among other types of pressure force, in a case where pressure force acts within a limited width over the roughly entire height of the body, as is the case where the pressure force acts on the bottle by way of the stopper of a product discharge mechanism inside a vending machine. As described above, a part of a pillar section always exists somewhere in the height range of panels at any central-angle position chosen relative to the central axis of the bottle. Under this configuration, the level of deflection can be controlled at whatever central-angle position the lateral load would act on the body, because this lateral load can be supported by three portions including the upper and lower circular sections and the pillar sections disposed in between.

In the case of conventional bottles having upright pillar sections, the lateral load may act over the roughly entire height range of the body and across the width limited to a central-angle position at which there is no pillar section. At that position, the load would be supported only by the two sections of the upper and lower circular sections, and deflective deformation would be large.

The angle of gradient may be increased so as to at least the upper end of a given pillar section is disposed at the same central-axis position as the lower end of a adjacent pillar section Under the above-described configuration, the central-axis position of any pillar section at its upper end is aligned vertically with the central-axis position at the lower end of the related adjacent pillar section. Because of this alignment, multiple pillar sections are connected one by one, and on the whole, are disposed around the body so that the pillar sections can effectively perform the function as a circumferential rib.

If a larger angle of gradient is used, the pillar sections become more inclined until the upper end of each pillar section is overlapped with the lower end of the related adjacent pillar section. As described above, the extent to which the pillar sections are inclined should be determined as the matter of design, along with the rigidity and strength of the pillar sections in the vertical direction and the details of artistic design work.

This configuration shows one of practical configurations to determine the angle of gradient for pillar sections in such a way that a part of a pillar section exists somewhere in the height range of a panel in the bottle having dented panels. Under this configuration, the upper end of a pillar section is more or less aligned vertically with the lower end of the next pillar section. Therefore, a part of a pillar section can always be located somewhere in the height range in which a panel is formed.

The upper base and lower base of each pillar section at both ends may be widened by rounding panel corners to form arch shapes.

Under the above-described configuration, the connection of pillar sections with the upper and lower circular sections is strengthened by extending the width of the upper base and the lower base of each pillar section. As a result, load is dispersed more effectively, and the rigidity and strength in the lateral direction can be increased.

The widened upper and lower bases can also be utilized to ensure that the upper end of any pillar section and the lower end of a related adjacent pillar section can be partially overlapped in the plan view even at a smaller angle of gradient, and thus to ease restrictions on the design associated with the angle of gradient.

This invention having the above-described configurations has the following effects:

The pillar sections are inclined relative to the central axis of the bottle. In addition to performing the function as the support to bear the originally intended load in the vertical direction, these pillar sections also play the role of a circumferential rib or ridge to improve the rigidity and strength that can resist the pressure force acting in the lateral direction.

The dented panels are one of the configurations of the pillar sections that are inclined relative to the central axis of the bottle. The portions around these panels remain undented to form the pillar sections and the circular sections. These pillar sections and circular sections are connected integrally to set up a network of ribs disposed over the entire body. This configuration allows the load to be scattered, and effectively increases the rigidity and strength of the body that can resist the pressure force in the lateral direction.

The rigidity and strength of the bottle can be secured without sacrificing the area of panels. Therefore, the bottle of this invention can be utilized for a hot filling application by designing the shape of dented panels properly and allowing the panels to perform the function as the vacuum-absorbing panels.

The at least three parts comprising the upper and lower circular sections and the pillar sections disposed in between can bear the lateral load that acts on the body over the entire height range but in limited width, such as the load that especially acts on the bodies of bottles put inside vending machines. This configuration is also effective to prevent deflection that tends to occur on the carrier line, in storage on the stacks, and in other situations in which similar lateral load acts on the bodies of bottles, in addition to the situation inside the vending machine.

The multiple pillar sections are connected and disposed around the entire body. Under this configuration, the pillar sections can effectively perform the function as a circumferential rib.

The connection of the pillar sections with the upper and lower circular sections is strengthened by extending the width of the upper base and the lower base of each pillar section. As a result, load is dispersed more effectively, and the rigidity and strength in the lateral direction can be increased. Furthermore, the widened upper and lower bases can also be utilized to ensure that the upper end of any pillar section and the lower end of a next pillar section can be partially overlapped even at a smaller angle of gradient, and thereby to ease restrictions on the design work associated with the angle of gradient.

BRIEF DESCRIPTION OF THE DRAWINGS

FIG. 1 is a front elevational view of the entire bottle in one embodiment of this invention.

FIG. 2(*a*) is a plan view of the bottle taken from line A-A in FIG. 1, and FIG. 2(*b*) is a vertical section of a panel taken from line B-B.

FIG. 3 is a development diagram showing the body of the bottle in FIG. 1, which is spread out in the circumferential direction.

FIG. 4 is another development diagram similar to FIG. 3, but with a change in the angle of gradient of the pillar section.

FIG. 5 is a front elevational view of the entire bottle in conventional art.

FIGS. 6(*a*)-6(*d*) are explanatory diagrams showing a method of deflection testing in synthetic resin bottles

DISCLOSED EMBODIMENTS

This invention is further described with respect to preferred embodiments, now referring to the drawings. FIGS. 1-3 show the synthetic resin bottle in one embodiment of this invention. FIG. 1 is a front elevational view of the bottle. FIG. 2(*a*) is a cross-sectional view of the bottle taken from line A-A in FIG. 1, and FIG. 2(*b*) is a vertical section of a later-described vacuum-absorbing panel 11 taken along line B-B, showing its dented shape. The bottle 1 is s biaxially drawn, blow molded product made of a PET resin. It is a small round bottle comprising a neck 2, a shoulder 3, a body 4, and a bottom 5, and the body 4 has a nominal capacity of 280 ml. The bottle has a total height of 132 mm, a maximum diameter Do of 66 mm, and a weight of 19 g.

Six vacuum-absorbing panels 11 are an embodiment of dented panels, and are formed by denting portions of cylindrical wall of the body 4 in a certain height range of the body 4. These panels are roughly flat plates and are in the shape of a parallelogram having four corners 12 rounded to give arc shapes. Pillar sections 15 in a projected strip-like shape are disposed between two adjacent vacuum-absorbing panels 11, and are inclined relative to the direction of central axis X of the bottle 1. Circular sections 16*t* and 16*b* in the shape of a short cylinder are disposed respectively on and under the vacuum-absorbing panels 11, and are provided with a circumferential groove 17. These circular sections perform a function as circumferential ribs and secure rigidity enough to resist the pressure force in the lateral direction of the bottle.

In particular, the pillar sections 15 stand out in relief when the vacuum-absorbing panels 11 are formed in a dented state. The pillar sections 15 in the projected strip-like shape are inclined relative to the central axis X, and are disposed spirally around the cylindrical wall of the body 4 at the same distance from the central axis X.

FIG. 3 is a development diagram in which to spread out the cylindrical wall of the body 4 of the bottle 1 of FIG. 1 in the circumferential direction. The pillar sections 15 are inclined relative to the central axis X at an angle of gradient, $\alpha$, of 31 degrees. Corners 12 have two curvature radii R1 and R2, which are 3.2 mm and 10 mm, respectively. The angle of gradient $\alpha$ is determined in such a way that the upper end 15*ta* of any optional pillar section 15*a* is disposed at the same central-axis position E1 as the lower end 15*bb* of a related adjacent pillar section 15*b*. At that time, the central-angle range G between the upper end 15*ta* and the lower end 15*ba* of any pillar section 15*a* is 60 degrees (360°/6)

When the pillar sections 15 have such an angle of gradient α, a part of a pillar section 15 can always be disposed somewhere in the height range of the vacuum-absorbing panels 11 at any central-angle position E on the cylindrical wall of the body 4.

For example, at the central-angle position E2, a portion of a pillar section exists at about middle height of a vacuum-absorbing panel 11. At the central-angle position E1, portions of pillar sections 15 exist at the upper and lower ends. Therefore, at any central-angle position E on the body 4, the pillar sections 15 along with the upper and lower circular sections 16*t* and 16*b* can directly bear the load even if lateral load acts on the body linearly over the entire height range in limited width.

Deflection tests using lateral load, such as shown in FIGS. 6(*a*)-6(*d*) were conducted to compare the bottle 1 in the above-described embodiments and the bottle 101 in a conventional example shown in FIG. 5. The bottle 101 in the conventional example was molded to give the same capacity, height, maximum diameter Do, and weight as those of the bottle 1. A test jig P in the shape of a square rod made of steel of 10 mm wide was used in the tests to apply the lateral load onto the bottle body over the entire height range in the width of 10 mm. The lateral load of 6 kgf was applied to one side of the test bottle which was put sideways. Diameter D of the body was measured after the bottle was deflected and deformed under lateral load of 6 kgf (See FIG. 6(*d*)), while turning the bottle on the central axis X at each time of measurement in order to change the central-angle position E with which the jig P came in contact (See FIGS. 6(*b*) and 6(*c*)).

Test results are as follows:

(1) The Bottle 1 of this Invention

Deformation was almost similar at any central-angle position E. Average value of diameter D after the deformation was 61.98 mm (standard deviation: 0.12)

(2) Conventional Bottle 101

If the bottle was turned over to set a central angle position E where the pillar sections are on both of upside and downside (the case of FIG. 6(*b*)), the average value of the diameter D after the deformation was 61.85 mm (standard deviation: 0.27). At a central angle position E where the vacuum-absorbing panels are on both of upside and downside (the case of FIG. 6(*c*)), the average value of the diameter D was 58.46 mm (standard deviation: 0.69). The vacuum-absorbing function of the vacuum-absorbing panels was also tested in the hot filling of contents. It was found that both the bottle 1 of this invention and the conventional bottle 101 performed the function fully, with no problem in practical applications.

As shown in the test using a conventional bottle 101, in which lateral load was applied onto a vacuum-absorbing panel 111, deflective deformation was considerably large, as compared to the case where the load was applied to a pillar section 115. On this point, the bottle 1 of this invention was successful in eliminating those largely deformed portions at any central-angle position without increasing the bottle weight and/or the body wall thickness. Thus, the test results confirmed the action and effect of this invention having the configuration of inclined pillar sections 15.

What is more, results of the test with the bottle 1 of this invention showed that the standard deviation was as small as 0.12 when the average diameter D was 61.98 after the bottle was deformed. This test result indicates that deflective deformation is constant without relation to the central angle position E. In this regard, it is reasonable to suspect that the effects of this invention are not derived merely by inclining a pillar section 15, but that multiple pillar sections 15 are inclined and integrally connected with the upper and lower circular sections 16*t* and 16*b* so that a load-dispersing effect is achieved by a network of ribs in the tall strip shape and the circular sections, which is set up over the entire wall of the body 4.

FIG. 4 shows an embodiment of the pillar sections 15 in which the angle of gradient, α, was made as small as 20 degrees, with other conditions being set alike in the embodiment of FIG. 1. Like the development diagram of FIG. 3, FIG. 4 shows only a part of the pillar sections. As found in FIG. 4, the upper end 15*ta* of a pillar section 15*a* is not completely aligned with the lower end 15*bb* of a related adjacent pillar section 15*b*. However, since the corners 12 are rounded in arc to give the upper end 15*ta* and the lower end 15*bb* a wider base, a portion of the pillar section 15*a* and a portion of the pillar section 15*b* can be partially overlapped in the plan view by a narrow margin even at such a central angle position as E3.

Although overlap is marginal, it is possible for the pillar sections to bear the load directly, because in many cases, the lateral load is not applied linearly but in some width actually (10 mm in the case of jig P shown in FIG. 6(*a*). With this point kept in mind, the angle of gradient, α, can be reduced so as to ease the restrictions on the design, including rigidity in the vertical direction and artistic design work. It should be understood here that if the pillar sections 15 had increased width along the entire pillars, the width of each vacuum-absorbing panel 11 would become limited, and there would be difficulty in fully performing the vacuum-absorbing function.

Illustrative embodiments and action/effect of this invention are as described above. However, this invention should not be construed as limitative to the above-described embodiments, but can also be applied generally to bottles other than those made of PET resins. In addition, this invention can be applied not only to the bottles having a round body, but also to the bottles having a regular hexagonal, octagonal, elliptical, or oval body. The vacuum-absorbing panels, too, are not limited to the embodiments of this invention in their number. The action and effect of this invention is achieved not only in small bottles but also in the bottles with a size of about 1 liter.

The lateral load such as shown in FIGS. 6(*a*)-6(*d*) has been described in the embodiments of this invention. The action and effect of this invention brought about by the configuration of inclined pillar sections are not limited to these embodiments, but can respond to the lateral load that is applied in various aspects. For example, the action and effect of this invention can be fully achieved against the lateral load applied by using the jig P of FIG. 6(*a*) set in the direction perpendicular to the central axis X and squeezing the body with the jig at a certain height of the body.

The angle of gradient, α, can be selected in response to various types of lateral load, while giving consideration to the rigidity and strength in the vertical direction and the artistic design work. Depending on the type of lateral load, it is not always necessary to determine an angle of gradient, α, so that the upper end 15*ta* of a given pillar section 15*a* and the lower end 15*bb* of a related adjacent pillar section 15*b* are disposed at the same central-angle position E1, as found in FIG. 3. These upper end and lower ends can be disposed apart from each other in the plan view by selecting a smaller angle of gradient, α. Instead, this a can be increased further, if necessary, to overlap adjacent pillar sections in the plan view.

INDUSTRIAL APPLICABILITY

As described above, the synthetic resin bottle of this invention has a sufficient vacuum-absorbing function. High rigidity and strength of the bottle against lateral load has been achieved without increasing the amount of resin. The bottle can be utilized reliably, and therefore, wide applications of use are expected on the carrier line, in storage on the stacks, in the vending machine, and at other scenes where deformation caused by lateral load is problematic.

The invention claimed is:

1. A synthetic resin bottle comprising:

multiple pillar sections in a projected strip-like shape disposed on a body of the bottle, wherein said pillar sections are inclined spirally at a uniform angle of gradient (α) relative to a central axis of the bottle and disposed in parallel to one another, so that a cylindrical wall of the body is prevented from being deformed by a pressure force that acts in a lateral direction, portions of the cylindrical wall of the body are dented in a certain height range to form multiple dented panels, which are in parallel to one another in the circumferential direction, with each pillar section being disposed between two adjacent panels, and the angle of gradient (α) is adjusted so that a part of a pillar section always exists somewhere in the height range of panels at any central angle position (E) chosen relative to the central axis of the bottle.

2. The synthetic resin bottle according to claim 1, wherein the panels are vacuum-absorbing panels.

3. The synthetic resin bottle according to claim 2, wherein an angle of gradient (α) is increased so that at least an upper end of a given pillar section is disposed at a same central-axis position (E) as a lower end of an adjacent pillar section.

4. The synthetic resin bottle according to claim 2, wherein base lines of each pillar section at both of upper and lower ends are widened by rounding panel corners to form arch shapes.

5. The synthetic resin bottle according to claim 1, wherein an angle of gradient (α) is increased so that at least an upper end of a given pillar section is disposed at a same central-axis position (E) as a lower end of an adjacent pillar section.

6. The synthetic resin bottle according to claim 5, wherein base lines of each pillar section at both of upper and lower ends are widened by rounding panel corners to form arch shapes.

7. The synthetic resin bottle according to claim 1, wherein base lines of each pillar section at both of upper and lower ends are widened by rounding panel corners to form arch shapes.

* * * * *